United States Patent [19]

Segneri

[11] Patent Number: 5,007,224

[45] Date of Patent: Apr. 16, 1991

[54] TOOL AND METHOD FOR INSTALLING ROOF GUTTERS ON BUILDINGS

[76] Inventor: Carl L. Segneri, 16054 University Ave., South Holland, Ill. 60473

[21] Appl. No.: 514,749

[22] Filed: Apr. 26, 1990

[51] Int. Cl.[5] ..... B25C 1/02

[52] U.S. Cl. ..... 52/741; 52/11; 227/147; 227/148

[58] Field of Search ..... 227/147, 148; 248/48.1, 248/48.2; 169/904, 102; 52/11, 741, 749

[56] References Cited

U.S. PATENT DOCUMENTS

| | | | |
|---|---|---|---|
| 1,575,582 | 3/1926 | Joy . | |
| 2,430,322 | 11/1947 | Anstett | 227/148 |
| 2,686,960 | 8/1954 | LeRoy | 248/48.2 |
| 2,879,962 | 3/1959 | Biskup | 248/48.1 |
| 4,210,301 | 7/1980 | Weiss | 248/48.2 |
| 4,437,602 | 3/1984 | Kaczmarek | 227/147 |
| 4,564,182 | 6/1985 | Svajgl . | |
| 4,733,812 | 3/1988 | Lewis | 227/148 |
| 4,874,123 | 10/1989 | Mercer | 227/147 |

*Primary Examiner*—John E. Murtagh
*Attorney, Agent, or Firm*—Clement and Ryan

[57] ABSTRACT

A hand tool, and method of using the same, for installing roof gutters on a residence or other building. The tool may be used to position the gutter temporarily against the building wall as the tool is held in one of the user's hands, without any attachment of the gutter or the tool to the building being necessary. The user may use his other hand to hold a hammer to strike the free end of a nail-driving piston—which is held and guided, together with a nail, by the tool—to drive the nail through the rear wall of the gutter and/or the rear portion of the associated hanger, and then into the building wall. The tool may then be freely and immediately moved away from the gutter.

13 Claims, 1 Drawing Sheet

FIG. 1
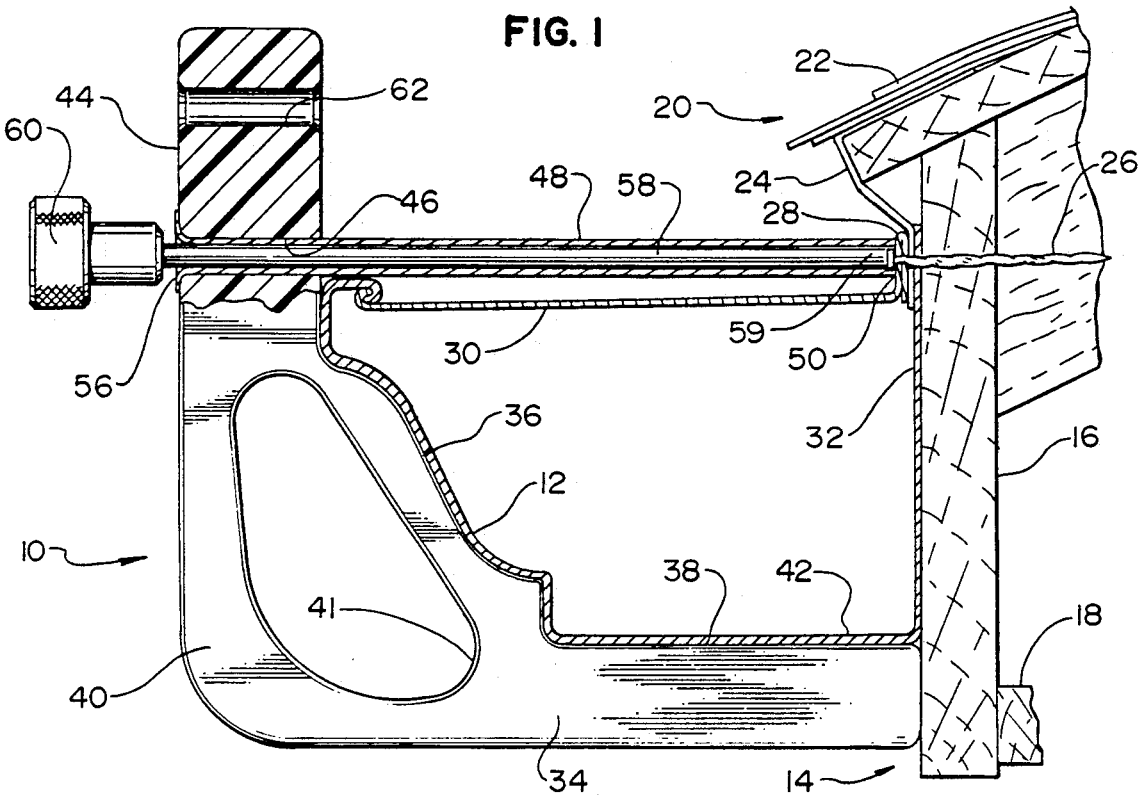
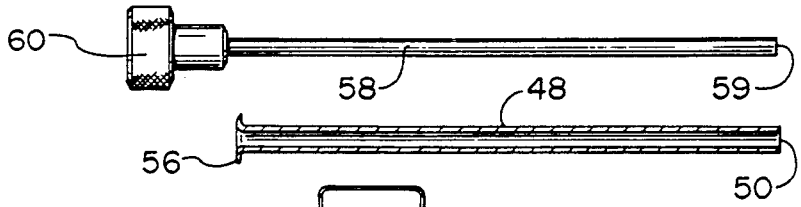
FIG. 2
FIG. 3
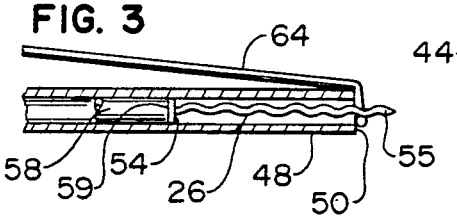
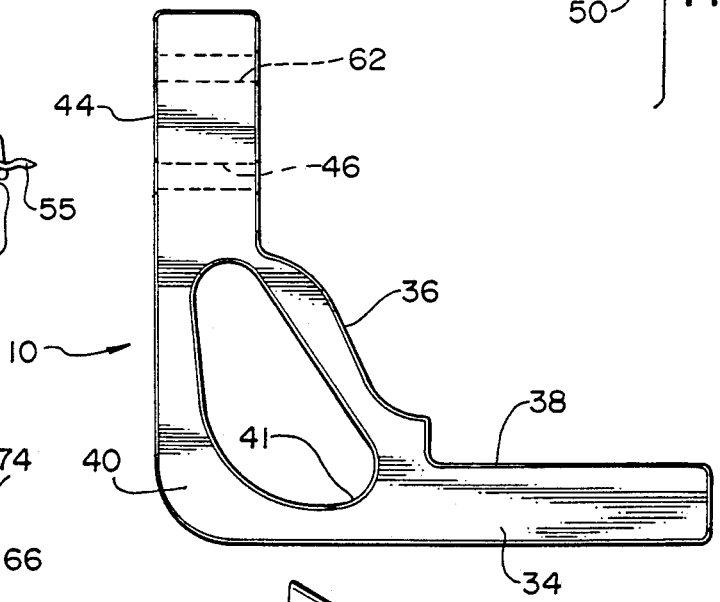
FIG. 4
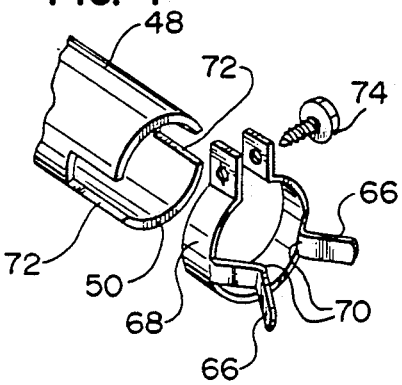
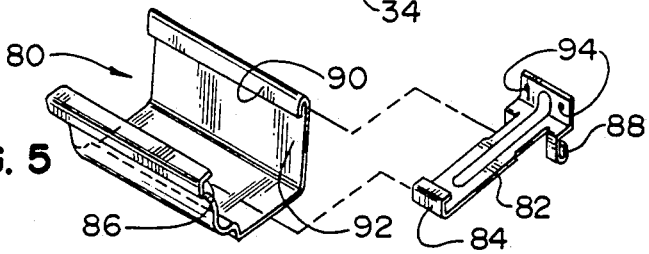
FIG. 5

TOOL AND METHOD FOR INSTALLING ROOF GUTTERS ON BUILDINGS

FIELD OF INVENTION

This invention relates to a tool for installing roof gutters on a residence or other building, and to a method of installing such gutters. In particular, it relates to a gutter installation hand tool that may be used to position the gutter temporarily against the building wall as the tool is held in one of the user's hands, so that the user may use his other hand to hold a hammer to drive a nail through the rear wall of the gutter and/or the rear portion of the associated hanger, and then into the building wall.

BACKGROUND OF THE INVENTION

Gutters are normally secured to the fascia board that extends downward from the outer edge of the roof portion of a residence or other building on which the gutters are installed. Installation of the gutters in this location has presented several problems that have been recognized, but have been unsolved, for many years. The present invention meets and overcomes all the problems that have long been faced by those installing roof gutters on residences and other buidings. p The conventional method of installing a gutter is for one or two workers to grasp the gutter and hold it in place while nails are hammered into the fascia board to secure the gutter to the building. The fact that the gutter protrudes outward from the building means that these hammer blows must be struck from above the gutter. The space in which the hammering can be done is further limited by the fact that the roof shingles and the flashing associated with the roof usually extend a considerable distance outward from the building, just above the location where the nails are to be hammered to secure the gutter.

The resulting cramped quarters for hammering the gutter-supporting nails make it extremely awkward for a worker, especially when working at the top of a ladder, to reach into the space that is severely constricted as just described. Moreover, if the hammer blows are not confined exactly to the indicated restricted space, the roof shingles or the flashing may be damaged.

Svajgl U.S. Pat. No. 4,564,182 addressed some, but not all, of these problems. That device is intended for use only with the spike and ferrule type of attachment of gutters. As seen from FIG. 3 of the patent, with this type of attachment the head of the spike being hammered is located at the front of the gutter instead of at the rear, and is entirely clear of the shingle and flashing overhang above the gutter. Thus the Svajgl device does nothing about the above described problems of inaccessibility and danger of damage to the roof overhang when shorter nails are used with an associated hanger to support the gutter, as is the case with a great many installations.

Svajgl's solution to the problems of gutter installation is very different from the present invention. Rather than a hand-held support, a fixed (although temporary) support is provided for the gutter that is being installed. As is seen from the disclosure in the Svagjl patent, the use of that device involves three extra steps, none of which is required with applicant's invention, in order to secure the gutter to the building. These three extra steps are the pounding of nail 48, the pounding of nail 50, and the hanging of inner frame member 20 of support 10 on those nails. Then, because support 10 is fixed to the building during use and must be removed after each spike is driven in, this removal is a fourth extra step. All four extra steps are not only inconvenient but are time-consuming as well.

Finally, when the Svajgl device is removed, nails 48 and 50 must be left in place—partially protruding from the fascia board—behind the installed gutter. (The reason the head and a small part of the shank of each nail 48 and 50 must protrude from the fascia board is in order that member 20 of support 10 can be hung on the nails in the manner disclosed in the patent, with the shanks of the nails removably seated in elongated slots 36 and 40 located in inner frame member 10.) After the nailing of the gutter to the building is completed, the gutter presses tightly against the building and therefore also against the two protruding nails. This increases the inconvenience of removing support 10, for the gutter must be pulled away from the building momentarily to allow inner frame member 20 of support 10 to be slid up and then out over the protruding nails. Moreover, with the passage of time the pressing of the nail heads against the rear wall of the gutter will result in wear in that wall, as the gutter rubs against the nail heads as it expands and contracts during extreme changes in outside temperatures. This wear will increase the risk of rusting with a galvanized steel gutter, or the actual wearing of a hole in a gutter formed of thin sheet aluminum.

Guides utilizing a nail-driving plunger or pin, such as disclosed in Joy U.S. Pat. No. 1,575,582, have been known for a great many years. However, in spite of the very troublesome problems that through all those years have plagued workers installing gutters on houses and other buildings, no one so far as applicant is aware has previously combined those early nail-driving devices with the other elements used by applicant to produce the present invention.

SUMMARY OF THE INVENTION

The gutter installation hand tool of this invention includes means for temporarily positioning a gutter in place against the building wall on which it is to be installed, by (1) providing support for the bottom wall of the gutter, and (2) holding the gutter against moving away from the building, all before the gutter is attached to the building and without any attachment of the tool (even temporary) to the building. In a preferred embodiment, the tool is provided with an upside-down pistol type grip, which can be grasped by one of the user's hands in order that the tool can be held against the gutter to maintain the temporary positioning of the gutter against the building on which it is to be installed.

A preferred embodiment of the tool of this invention includes a support frame for temporarily positioning the gutter during installation, in which frame the front edge and top edge have a shape generally complementary to a typical transverse cross section of gutters for residences and other buildings. In this preferred form, the support frame extends upward beyond the generally complementary shape, and a tube is seated in a bore in that upwardly extending portion for holding and guiding (1) a nail to help secure the gutter to the building, and (2) a nail-driving piston.

The tube just referred to is open at its front end to receive a nail inserted backwards into the tube, and open at its flared back end to receive the nail-driving piston. The piston is positioned to engage, at its front end, the head of a nail inserted in the nail-receiving tube as just described, to drive the nail through the rear wall of the gutter and/or the rear portion of the associated hanger, and into the building wall, when the part of the piston that protrudes at its other end out of the piston-holding and guiding tube is struck with a hammer held in the user's other hand.

In one embodiment the upwardly extending portion of the support frame contains a second bore to accommodate a higher positioning of the nail- and piston-receiving tube when the gutter with which the tool is used is deeper than the usual type of roof gutter.

A method of using this type of gutter installation hand tool is also disclosed. The method includes the steps of (1) placing the hand-held tool of this invention adjacent the gutter to be installed, (2) inserting a nail backwards into the nail-receiving tube with a small portion of the nail protruding from the forward end of the tube, (3) locating the nail-driving piston in the tube in a position in which the forward end of the piston will contact the head of the nail and the rear portion of the piston protrudes out of the open back end of the tube, (4) with the tool held in one of the user's hands, placing and/or maintaining the gutter in the desired location against the wall of the building, and (5) then striking the outwardly extending back end of the nail-driving piston to move the piston forward and drive the nail through the rear wall of the gutter and/or the rear portion of the associated hanger, and then into the building wall. The first three steps recited may be carried out in any order, and the fourth and fifth step follow as the final two steps of the method in the order given.

BRIEF DESCRIPTION OF THE DRAWING

The invention will now be described in more detail, by reference to the accompanying drawing, in which:

FIG. 1 is a side elevation view, partly broken away, of the hand tool of this invention, shown in place adjacent a gutter being installed, immediately after the tool has been used to drive a nail through the rear portion of the gutter hanger, the rear wall of the gutter itself and into the wall of the building on which the gutter is being installed;

FIG. 2 is a somewhat reduced, exploded side elevation view of the embodiment of FIG. 1 showing the nail-driving piston and its guide tube (the latter in section) before those members are installed in the upwardly extending portion of the support frame of the tool;

FIG. 3 is a fragmentary sectional view of the nail-driving piston and its guide tube, with the nail held in place within the tube by use of an elastic rubber band;

FIG. 4 is an enlarged, fragmentary, exploded view of a spring clip used at the open front end of the nail-guiding tube to hold the nail within the tube until it is driven into place by hammer blows struck on the free end of the piston; and FIG. 5 is a fragmentary, exploded view of a second type of roof gutter with which the tool and method of this invention may be used.

DETAILED DESCRIPTION OF A PREFERRED EMBODIMENT

FIG. 1 is a side elevation view of a preferred embodiment of the gutter installation hand tool 10 of this invention, shown in place adjacent a gutter 12 being installed on a building such as a residence.

Location of Gutter On The Building

Hand tool 10 is being used in the view shown in FIG. 1 to install gutter 12 on residence 14 in the desired place against the wall of the building. In this installation, the gutter is being nailed to fascia board 16 above soffit board 18.

The position in which the gutter is being installed is just below the outer edge of roof 20. As is common in the construction of such roofs, roof shingles 22 and flashing 24 associated with the roof extend a considerable distance outward from the building, just above the location where nail 26 is to be hammered in to help secure the gutter to the building.

As seen in FIG. 1, nail 26 may have a spiral shape, which is frequently the case with nails used to secure roof gutters to buildings. In FIG. 1, nail 26 has been driven by the user of hand installation tool 10 through rear portion 28 of gutter hanger 30, through flashing 24 (which extends downward to overlap the gutter), and then through the upper portion of rear wall 32 of the gutter and into fascia board 16 to secure the gutter to the building. Preferably, the nail is driven at a location that will mean that after it passes through fascia board 16 the forward portion of the nail enters one of the rafters 33 that supports the roof of the building, to make for a more secure attachment of the gutter to the building.

As will be readily understood, after a nail has been driven into place, hand tool 10 can be freely and immediately moved away from the gutter (to the left in FIG. 1), in preparation for inserting another nail in the nail-guiding means, adjusting the position of the nail-driving piston, and moving the tool with the nail in its ready position to another location at which a nail is to be driven into the building wall to help secure the gutter in place.

Support Frame And Pistol Type Grip

Support frame 34, as seen in FIG. 1, is adapted to position gutter 12 temporarily in the desired position for installation of the gutter on building 14. The support frame may be formed of any suitable material—such as polyurethane, for example—that is both strong and light in weight.

The transverse cross-sectional shape of the gutter shown in FIG. 1 is typical of roof gutters for residences. Front edge 36 and top edge 38 of support frame 34 together have a shape generally complementary to the transverse cross section of gutter 12.

In the embodiment shown, gutter installation hand tool 10 can be conveniently held in one hand of the user of the tool by grasping upside-down pistol type grip 40 secured to support frame 34 at the bottom rear corner 41 of the frame. The hand tool of this invention may have any other suitable configuration by which the tool may be held in one of the user's hands to maintain the position of the gutter while each nail is being driven into the building wall to secure the gutter to the building.

Gutter 12 is temporarily positioned for installation on building 14 in the desired place against the wall of the building through the support that is provided by upper edge 38 of frame 34 for gutter bottom wall 42. At the same time, tool 10 held in the user's hand prevents the gutter from moving away from the building wall. This is accomplished without even a temporary attachment of tool 10 to the building to which the gutter is to be secured.

Nail and Piston Guide Means

Support frame 34 extends upward at 44 beyond the complementary shape formed by its edges 36 and 38.

Bore 46 passes through upwardly extending portion 44 from one side of that upwardly extending member to the other. Tube 48 is seated in bore 46 with a press fit, substantially perpendicular—when hand tool 10 is held in position against the building during use of the tool—to the building wall on which the roof gutter is to be installed.

Tube 48 is open at its front end 50 to receive spiral nail 26 inserted backwards into the tube in the manner shown in FIG. 3. Tube 48 has an inside diameter large enough to receive head 54 of a nail of any of the various sizes of nails with which hand tool 10 will be used.

Tube 48 is open at its back end to receive nail-driving piston 58, tube back end 56 being outwardly flared to facilitate insertion of the piston in the tube. Nail-driving piston 58 forms a close, sliding fit with the inner surface of piston-receiving tube 48. The piston can be readily driven forward against the head of the nail, yet because of the close fit will not tend to fall out of tube 48 when hand tool 10 is up-ended. Nail- and piston-guiding means 48 can be formed of any suitable material such as tool steel.

Nail-driving piston 58 has an enlarged head 60 at its outer end, which will take the blows of the hammer applied by the user of hand tool 10. Enlarged head 60 is preferably knurled for easy grasping by the user of the tool, when piston 58 is pulled back in tube 48 to make room for another nail 26 to be inserted through the open forward end of the tube.

As will be seen from FIG. 1, tube 48 serves to hold and guide nail 26 and nail-driving piston 58. As shown, piston 58 is in contact at its forward end 59 with head 54 of nail 52, and has driven the nail through rear portion 28 of hanger 30, flashing 24, and rear wall 32 of gutter 12, into fascia board 16. To accomplish this, the gutter has been temporarily maintained in place against the building wall in the desired position by the tool held in one of the user's hands, and the user has struck the free, enlarged end 60 of nail-driving piston 58 with a hammer held in the user's other hand.

In the embodiment of the hand tool of this invention illustrated in FIG. 1, a second bore 62 is provided near the uppermost end of upward extension 44 of support frame 34. As will be seen, this permits tube 48 to be removed from lower bore 46 and inserted in the upper bore, so that tool 10 can be used with roof gutters that have a higher cross-sectional profile than the more conventional shape of gutter 12 in FIG. 1.

FIG. 2 illustrates the hand tool of this invention when disassembled to move piston- and nail-guiding means 48 from one bore to the other. As will be seen, after the tool has been assembled with tube 48 inserted with a press fit into either bore 46 or 62, a large gap will be present at the front of the tool (on the right-hand side of FIG. 2). This will permit easy and convenient positioning of the tool around a length of gutter, either before that piece of gutter has been raised into place or after it is partially secured in place and a second or subsequent nail is to be hammered into the building wall at another location.

Spring Clip For Holding Nail In Place In Nail-Guiding Tube

A simple way to hold nail 26 in place within nail-guiding tube 48 before the nail is driven into the building wall by nail-driving piston 58 is illustrated in FIG. 3. As there seen, portion 55 of nail 26 protrudes from open front end 50 of tube 48. Forward end 59 of the piston is seated against nail head 54, in preparation for the striking of hammer blows against piston free end 60 to drive nail 26 into the building. The nail can be held in this ready position, as seen in FIG. 3, by elastic rubber band 64 which is pulled back and placed in extended condition against the back edge (on the left in FIG. 1) of upward extension 44 of support frame 34.

FIG. 4 shows in an enlarged view a spring clip that is preferred for the purpose of holding the nail within the nail-guiding tube 48. Spring fingers 66 of clip 68 are flexible enough to permit nail head 54 to pass between them when nail 26 is inserted in the nail-guiding tube through its open forward end 50, and thereafter to permit nail head 54 to pass between fingers 66 when the nail is pounded into the building.

As seen in the exploded view of FIG. 4, bent portions 70 of spring fingers 66 are seated in slots 72 adjacent to open end 50 of tube 48. Clip 68 is secured in this position by means of screw 74.

Method Of Invention

As will be seen from the Figures of the drawing, the method of this invention provides a series of easy and convenient steps for securing a roof gutter to a building without any of the disadvantages of prior art devices used for the same purpose.

In one step of this method, the tool held in one of the user's hands is placed adjacent the gutter to be installed, so that the tool is in position to provide support for the bottom wall of the gutter and to hold the gutter against the building wall in the desired position during installation of the gutter. If a length of gutter is being raised in place for the first time, the tool may be positioned around the gutter before the length of the gutter is carried up the ladder by the person installing it on the building. If one or more nails have already been hammered into place, the tool may be placed adjacent the gutter in a new location as the user stands at the top of the ladder. As will be seen from FIGS. 1 and 2, placing the hand tool in this way adjacent to the gutter is a simple and convenient movement, since the tool has a large open expanse, on the right-hand side of those Figures, into which the gutter will fit.

The other steps of this method are to insert a nail backwards into the nail-receiving tube, with a portion of the nail protruding from the forward end of the tube, and to position a nail-driving piston in the remaining portion of the nail-receiving tube. The forward end of the piston is positioned to contact the head of the nail, and the rear portion of the piston protrudes out of the open back end of the tube.

The three steps just discussed can be carried out in any order that is convenient. When a length of gutter has not yet been raised into place, it will be convenient to perform these steps in any order desired. When a length of gutter has already been partially secured in place by one or more nails, it will of course be necessary to remove the tool from around the gutter, perform the second and third steps just described (placement of the nail and piston in the guide tube) in any order desired, and then return the tool to its position for supporting the gutter while another nail is being hammered in place.

The user of the method of this invention holds the hand tool, with the gutter supported thereby, in one hand so as to place the gutter in the desired location against the wall of the building, which as already stated can be either the first spot at which a nail is driven into the building, or subsequent locations for a given length of gutter being installed. With the tool held in this way, the nail within the tube is in a position to be hammered into place to secure the gutter to the building wall.

The final step is simply to strike the outwardly extending free end of the nail-driving piston with a hammer held in the user's other hand, to move the piston forward and drive the nail into the building. As will be seen, the hand tool can then be removed from the gutter without further ado.

Other Types Of Roof Gutters

As explained above in connection with the discussion of FIG. 1 of the drawing, when installation hand tool 10 is used with a gutter having a hanger 30 of the type shown in that Figure, nail 26 is driven first through the rear portion of the hanger, then through flashing 24 (if desired), and finally through the upper portion of rear wall 32 of the gutter and into the building. The tool and method of this invention may also be used with gutters and hangers of other types. One of these is illustrated in the fragmentary, exploded view shown in FIG. 5.

Roof gutter 80 and hanger 82 comprise a free floating system that permits the gutter to expand and contract with temperature changes. The presence of stress points that can cause buckling and leaks is thereby minimized or avoided altogether.

In the embodiment illustrated in FIG. 5, flange 84 at the outer end of gutter hanger 82 fits into reentrant flange 86 at the upper end of the front wall of gutter 80. Reentrant flange 88 at the inner end of hanger 82 receives downwardly extending skirt or flange 90 at the upper end of rear wall 92 of gutter 80. As will be seen, as the walls of the gutter expand and contract with extreme changes in temperature, flange 90 is free to move within entrant flange 88.

When this type of roof gutter and associated hanger is used, the nails securing the gutter to the building do not pass through rear wall 92 of the gutter. The nails need only be inserted through nail-receiving apertures 94 and (if desired) flashing 24 before they are driven into the wall of the building.

It will be seen that the nails that are driven into the building by use of the hand tool and method of this invention can be driven through one or the other of the gutter hanger and the rear gutter wall, or through both, depending upon the type of gutter being installed.

While this invention has been described in connection with the best mode presently contemplated by the inventor for carrying out his invention, the preferred embodiment described and shown is for purposes of illustration, and is not to be construed as constituting any limitation of the invention. Modifications will be obvious to those skilled in the art, and all modifications that do not depart from the spirit of the invention are intended to be included within the scope of the appended claims.

I claim:

1. A gutter installation hand tool which comprises:

(a) means for temporarily positioning a gutter that is to be installed on a residence or other building in the desired place against the wall of the building by (i) providing support for the bottom wall of the gutter, and (ii) preventing the gutter from moving away from the building wall, all without any attachment of the gutter or the positioning means to the building;

(b) a piston positioned to contact, at its forward end, the head of a nail to drive the nail through at least one of the rear wall of the gutter and the rear portion of the associated hanger, and then into the building wall, when the piston is struck with a hammer on its other end; and (c) means for holding and guiding (i) a nail to secure the gutter to the building, and (ii) said nail-driving piston while the piston is in contact with the head of the nail, said tool being configured to be held in one of the user's hands to maintain said temporary positioning of the gutter, whereby the gutter may be temporarily maintained in place against the building wall by the tool held in one of the user's hands, and then at least partially secured to the building when the user strikes the free end of the nail-driving piston with a hammer held in the user's other hand to drive a nail positioned in the holding and guiding means through the rear wall of the gutter and/or the rear portion of the associated hanger, and then into the building wall.

2. The gutter installation hand tool of claim 1 in which said means for temporarily positioning a gutter to be installed on a building includes a support frame for the gutter the front edge and top edge of which have a shape generally complementary to a typical transverse cross section of such gutters.

3. The gutter installation hand tool of claim 2 in which:

(a) the support frame extends upward beyond said generally complementary shape, and (b) said holding and guiding means comprises a tube seated in a bore in said upwardly extending portion of the support frame, said tube being open at its front end to receive a nail inserted backwards into the tube, and open at its back end to receive said nail-driving piston.

4. The gutter installation hand tool of claim 3 in which the rear open end of said tube for receiving the nail-driving piston is outwardly flared.

5. The gutter installation hand tool of claim 3 in which the nail-driving piston forms a close, sliding fit with the inner surface of the piston-receiving tube.

6. The gutter installation hand tool of claim 3 in which the piston- and nail-receiving tube is seated in the bore in the upwardly extending portion of the support frame with a press fit.

7. The gutter installation tool of claim 3 in which a second bore in which said holding and guiding means can be seated, when it is desired to use the tool with another size of roof gutter, is located in said upwardly extending portion of the support frame.

8. The gutter installation hand tool of claim 2 which includes means for holding the tool in the user's , hand.

9. The gutter installation hand tool of claim 8 in which the means for holding the tool in the user's hand is an upside-down pistol type grip secured to said support frame.

10. The gutter installation hand tool of claim 3 in which a spring clip is positioned at the open front end of the piston- and nail-guiding tube to receive a nail inserted backward in the tube and to hold the nail there, with a portion of the nail protruding from the tube, until the nail-driving piston forces the nail out of the tube and into the building wall.

11. A gutter installation hand tool for installing a gutter on a residence or other building which comprises:

(a) a temporary support frame for the gutter to be installed on the building, the front edge and top edge of the support frame having a shape generally complementary to a typical transverse cross section of such gutters, the support frame extending upward beyond said generally complementary shape, a bore extending through said upwardly extending portion of the support frame, the bottom rear corner of the tool having the shape of an upside-down pistol type grip for grasping by the user of the tool;

(b) a piston positioned to contact, at its forward end, the head of a nail to drive the nail through at least one of the rear wall of the gutter and the rear portion of the associated hanger, and then into the building wall, when the piston is struck with a hammer on its other end; and (c) a tube seated with a press fit in said bore in the upwardly extending portion of the support frame, said tube having an open front end to receive and guide a nail inserted backwards into the tube, and an open, outwardly flared back end to receive said nail-driving piston with a close, sliding fit and guide the piston while the piston is in contact with the head of the nail, whereby the gutter may be temporarily maintained in place against the building wall by the tool held in one of the user's hands, without any attachment of the gutter or the hand-held tool to the building, and then at least partially secured to the building when the user strikes the free end of the nail-driving piston with a hammer held in the user's other hand to drive a nail positioned in the holding and guiding means through the rear wall of the gutter and/or the rear portion of the associated hanger, and then into the building wall.

12. The gutter installation hand tool of claim 11 in which:

(a) the nail-driving piston forms a close, sliding fit with the inner surface of the piston-receiving tube, and (b) the piston- and nail-receiving tube is seated in the bore in the upwardly extending portion of the support frame with a press fit.

13. A method of installing a gutter on a residence or other building which comprises the steps of:

(a) placing adjacent the gutter which is to be installed on the building a hand-held tool adapted (i) to provide support for the bottom wall of the gutter, and (ii) to hold the gutter against the building wall in the desired position during installation of the gutter, all without any attachment of the gutter or the hand-held tool to the building, said tool including tube means to receive a nail inserted backwards into the tube means at its forward end, and to receive a nail-driving piston at the other end of the tube means;

(b) inserting a nail backwards into the nail-receiving tube means, with a portion of the nail protruding from the forward end of the tube means;

(c) locating a nail-driving piston in the remaining portion of the nail-receiving tube with the forward end of the piston positioned to contact the head of the nail and the rear portion of the piston protruding out of the open back end of the tube;

(d) holding the hand tool, with the gutter supported thereby, in one hand so as to place the gutter in the desired location against the wall of the building, with the nail in position to be hammered through at least one of the rear wall of the gutter and the rear portion of the associated hanger and then into the building wall; and (e) then striking the outwardly extending back end of the nail-driving piston with a hammer held in the other hand, to move the piston forward and drive the nail in as aforesaid, whereby the gutter can be maintained in the desired position against the building wall by means of the installation tool held in one of the user's hands, while the nail can be driven through the rear wall of the gutter and/or the rear portion of the associated hanger, and then into the building wall, by blows struck against the nail-driving piston by a hammer held in the other hand.

* * * * *